US005439009A

United States Patent [19]

Kushihashi et al.

[11] Patent Number: 5,439,009

[45] Date of Patent: Aug. 8, 1995

[54] DEVICE FOR GUIDING THE TRAVEL OF TOBACCO ROD IN A CIGARETTE MANUFACTURING APPARATUS

[75] Inventors: Shigenobu Kushihashi; Hiroshi Sakamoto, both of Tokyo, Japan

[73] Assignee: Japan Tobacco Inc., Tokyo, Japan

[21] Appl. No.: 258,376

[22] Filed: Jun. 10, 1994

Related U.S. Application Data

[63] Continuation of Ser. No. 57,040, May 5, 1993, abandoned.

[30] Foreign Application Priority Data

May 8, 1992 [JP] Japan ..... 4-115914

[51] Int. Cl.[6] ..... A24C 5/28

[52] U.S. Cl. ..... 131/84.1; 131/65

[58] Field of Search ..... 131/65, 904–907, 131/84.1

[56] References Cited

U.S. PATENT DOCUMENTS

| | | | |
|---|---|---|---|
| 3,244,050 | 4/1966 | Pym | 131/65 |
| 3,244,183 | 4/1966 | Pym | 131/65 |
| 3,526,232 | 9/1970 | Dearsley | 131/65 |
| 3,631,749 | 1/1972 | Poupin | 131/65 X |
| 3,760,672 | 9/1973 | Labee et al. | 131/65 X |
| 4,406,293 | 9/1983 | Maldina | 131/65 X |
| 5,050,471 | 9/1991 | Niemann | 131/65 X |

FOREIGN PATENT DOCUMENTS

| | | | |
|---|---|---|---|
| 0286828 | 10/1988 | European Pat. Off. | 131/285 |

*Primary Examiner*—Jennifer Bahr

[57] ABSTRACT

The device according to the present invention has a delivery axis of tobacco rod which extends from a wrapping section to an inspecting section in a cigarette manufacturing apparatus, a rod guide which can move between the forward position on the delivery axis and the backward position away from the delivery axis, the rod guide directing and leading the tobacco rod sent out from the wrapping section to the inspecting section, and a rod deflector which is located above the rod guide and which can rotate from an up position that is higher than the delivery axis to a down position where the delivery axis is shut off, the rod deflector cutting the tobacco rod and also deflecting the delivery direction of the tobacco rod on the wrapping section side to lead it into a dust box when the rod deflector rotates from the up position to the down position.

19 Claims, 8 Drawing Sheets

DEVICE FOR GUIDING THE TRAVEL OF TOBACCO ROD IN A CIGARETTE MANUFACTURING APPARATUS

This application is a continuation of application Ser. No. 08/057,040 filed on May 5, 1993, now abandoned.

BACKGROUND OF THE INVENTION

1. Field of the Invention

The present invention relates to a device for guiding the travel of a produced tobacco rod when the tobacco rod is carried toward a cutting section in a cigarette manufacturing apparatus.

2. Description of the Related Art

A cigarette manufacturing apparatus mainly comprised of a wrapping section and a cutting section. In the wrapping section, a paper web is fed in one direction, and during such a feeding process, shredded tobacco supplied onto the paper web is continuously wrapped with the paper web, thus forming tobacco rods in succession.

The formed tobacco rod is then sent from the wrapping section to the cutting section which cuts the rod into individual cigarettes of a specified length.

The cigarette manufacturing apparatus is further provided with an Inspecting section which is located between the wrapping section and the cutting section. In the inspecting section, the diameter of a formed tobacco rod, the filling density of the shredded tobacco in the tobacco rod, etc. are immediately inspected, and the inspection results are supplied to the wrapping section.

In the wrapping section, the diameter of tobacco rod to be formed and the supply of shredded tobacco onto the paper web are controlled according to the inspection results. As a result, the quality of the tobacco rods Is maintained at a constant level.

Regarding the operation of the cigarette manufacturing apparatus, If any trouble takes place, a stopping signal is immediately sent to the wrapping section. After the stopping signal is issued, however, it takes a certain time before the drive of the wrapping section, i.e., the feed of a paper web or the delivery of a tobacco rod, is completed stopped.

If the cause of such a trouble lies in the forming of a tobacco rod, i.e., the wrapping of shredded tobacco with the paper web, then a formed product sent out from the wrapping section may not be complete tobacco rod. This will prevent the incomplete rod sent out from the wrapping section from passing through the inspecting section, causing it to be stuck between the wrapping section and the inspecting section, and what is worse, the shredded tobacco inside will be scattered around. The quantity of stagnant defective rod and the quantity of scattering shredded tobacco increase as the driving speed of the cigarette manufacturing apparatus, i.e., the wrapping section, increases with a consequent longer time required for stopping the wrapping section.

It is desirable, therefore, to secure as great a distance as possible between the inspecting section and the wrapping section, considering the possible stagnation of defective rod resulting from an operational interruption of the cigarette manufacturing apparatus or the scattering of shredded tobacco.

As the distance between the wrapping section and the inspecting section increases, however, the travel of tobacco rod becomes unstable when the tobacco rod is sent from the wrapping section to the inspecting section, frequently causing the tobacco rod to sway.

If there is significant sway of the tobacco rod, the tobacco rod may be caught at the entrance of the inspecting section, and an excessive force may be applied to the tobacco rod, causing the tobacco rod to be torn.

Further, at the time of restarting the cigarette manufacturing apparatus, the tobacco rod led out from the wrapping section is cut by a cutting means called a feed-in deflector at the end of the tobacco wrapping section and the tobacco rod, which is remained on the downstream side from the cut end, is sent out toward the inspecting section. Therefore, if the wrapping section is located far apart from the inspecting section, then the cut end of the tobacco rod cannot be guided stably toward the inspecting section.

SUMMARY OF THE INVENTION

An object of the present invention is to provide a device which is capable of stably guiding tobacco rod from a wrapping section toward an inspecting section at the time of restart or during operation of a cigarette manufacturing apparatus and which is also excellent in handling tobacco rod which continue to be fed out from the wrapping section when the operation of the cigarette manufacturing apparatus is interrupted.

The aforementioned object is achieved by the device according to the present invention. This device is provided with a tobacco rod delivery axis, which extends from the wrapping section toward the inspecting section, and a rod guide located in an operating position on the tobacco rod delivery axis, the rod guide directing the travel of a tobacco rod sent out from the aforesaid wrapping section and leading the tobacco rod to the inspecting section.

When the cigarette manufacturing apparatus is restarted and the tobacco rod remaining on the wrapping section is sent out from the wrapping section, the cut end of the tobacco rod is immediately guided to the rod guide and it is led to the inspecting section through the rod guide. Also during the operation of the cigarette manufacturing apparatus, the travel of a tobacco rod sent out from the wrapping section is guided by the rod guide, and as a result, the sway of a traveling tobacco rod is controlled also by the rod guide.

Preferably, the aforementioned device is further provided with second cutting means, which cuts a tobacco rod somewhere between the wrapping section and the inspecting section when the operation of the cigarette manufacturing apparatus is interrupted, and deflecting means which orients the cut end of the tobacco rod on the wrapping section side downward from the delivery axis and deflects the delivery direction of the tobacco rod from the wrapping section after the tobacco rod is cut by the second cutting means.

Accordingly, when the operation of the cigarette manufacturing apparatus is interrupted, the delivery direction of a tobacco rod remaining on the wrapping section side which has been cut by the second cutting means is deflected downward by the deflecting means, therefore, the tobacco rod which continue to be fed out from the wrapping section Is not moved toward the inspecting section during the period from the time of the operation was halted to the time of the drive of the wrapping section was completely stopped. In this case, preferably, in the direction into which the delivery of the tobacco rod is deflected, i.e., below the rod guide, a tobacco rod collecting container is provided.

As a result, even if the operation of the cigarette manufacturing apparatus is interrupted due to a tobacco rod forming failure, no defectively formed tobacco rod will be allowed to enter the inspecting section. Instead, such defectively formed tobacco rod will be collected into the collecting container. Accordingly, no tobacco rod will be scattered or no shredded tobacco In tobacco rod will be scattered around between the wrapping section and the inspecting section.

BRIEF DESCRIPTION OF THE DRAWINGS

The present invention will be better understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
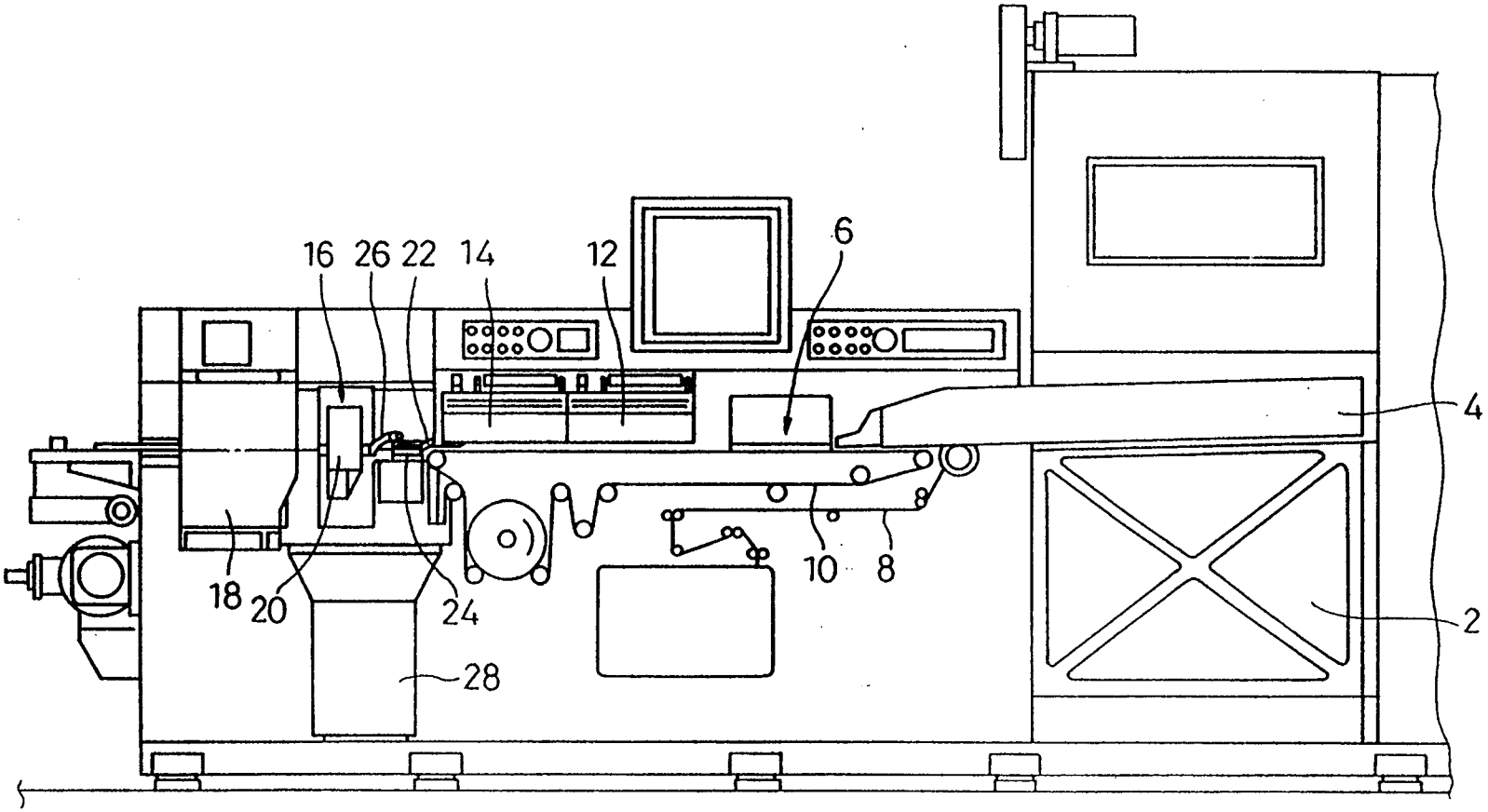
FIG. 1 is a schematic front view of a cigarette manufacturing apparatus.

Referring to FIG. 1, a cigarette manufacturing apparatus is provided with a chimney 2. The shredded tobacco supplied in the chimney 2 Is suctioned and moved up toward a suction unit 4, then it is held, in the form of a layer, onto the bottom surface of a suction belt (not shown) of the suction unit 4. The stratiform shredded tobacco is carried to the left as viewed in FIG. 1 as the suction belt moves and the thickness of the shredded tobacco layer is adjusted by a trimming unit which is not illustrated.

The metered stratiform shredded tobacco is then supplied from the suction belt onto a paper web 8 in a wrapping section 6. More specifically, the wrapping section 6 is provided with an endless garniture tape 10 used for carrying the paper web 8 and for forming tobacco rod. The garniture tape 10 is set on and fed by many rollers, thereby passing through the wrapping section 6 and being carried in a direction from the right end to the left end of the wrapping section 6 as viewed in FIG. 1.

The paper web 8 is paid out from a roll, which is not illustrated, and superimposed on the garniture tape 10 at the right end of the wrapping section 6, then it is carried with the garniture tape 10 in one direction.

When the paper web 8 passes through the wrapping section 6, the paper web 8 is first bent into a U shape together with the garniture tape 10. As a result, the shredded tobacco supplied onto the paper web 8 is wrapped with the paper web 8 from below. After that, one side of the U shaped paper web 8 is bent into a circular arc and glue is applied to the other side edge of the paper web 8, then the other side is also bent into a circular arc and it is glued to the one side edge. Hence, at this point, the shredded tobacco is completely wrapped in the paper web 8, thus forming tobacco rod In succession. The forming of the tobacco rod is publicly known; therefore a diagram showing the forming process is omitted.

The formed tobacco rod passes right under the first heater 12 and the second heater 14. At this time, the glued portion of the paper web 8 of the tobacco rod is dried, then the dried tobacco rod is sent out from the wrapping section 6.

The heaters 12 and 14 are arranged in order as viewed in the traveling or delivery direction of tobacco rod. These heaters 12 and 14 are capable of moving up and down independently, with respect to the tobacco rod that passes through the wrapping section 6. Accordingly, it is possible to use either both heaters or only one heater for drying tobacco rod.

The tobacco rod sent out from the wrapping section 6 then passes through an inspecting section, i.e., a measuring device 16 which measures the diameter of the tobacco rod, and it is supplied to a cutting section 18.

The measuring device 16 has a housing 20 and a pair of sensors (not shown) are installed in the housing 20. These sensors optically measure the widths of tobacco rod from two directions which orthogonally cross each other. The measuring device 16 outputs a mean value of the measurements, which are given by the pair of sensors, as the diameter of tobacco rod.

The tobacco rod, which has passed through the measuring device 16, is supplied to the cutting section 18 and it is cut by a prescribed length by the cutting section 18 into double size cigarettes. After that, these double size cigarettes are supplied from the cigarette manufacturing apparatus to a filter attachment in the next stage, and in the filter attachment, a filter is attached to an end of the single cigarette which is obtained by cutting the double size cigarette in the filter attachment, thus producing a cigarette with the filter.

Figure 2:
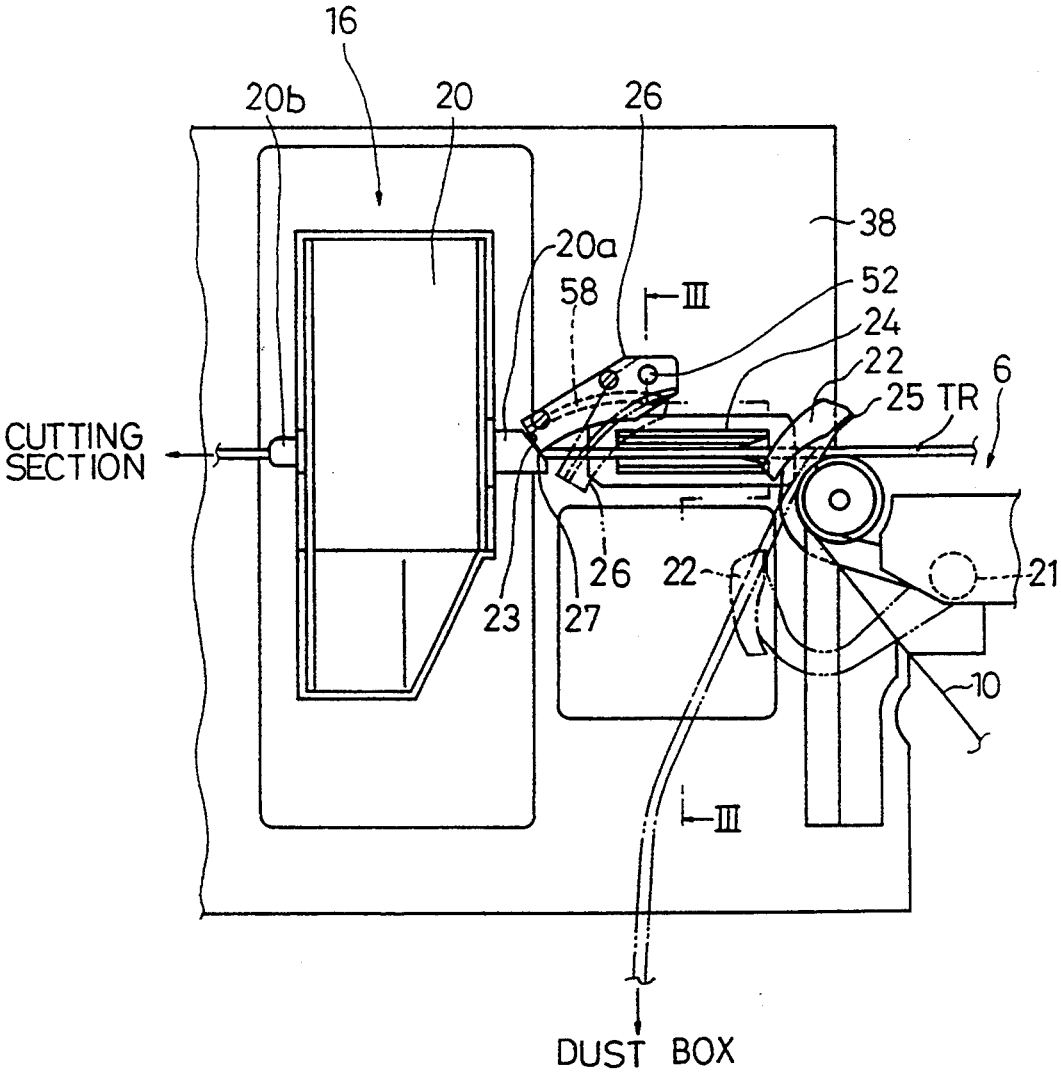
FIG. 2 is an enlarged view of the portion between the end of the wrapping section and a measuring device.

An enlarged view of the portion between the measuring device 16 and the wrapping section 6 is given in FIG. 2. As it is obvious from FIG. 2, a feed-in deflector 22 is provided on the terminal part of the wrapping section 6. The bottom end of the feed-in deflector 22 is mounted on the wrapping section 6 via a shaft 21 so that it is allowed to rotate, using the shaft 21 as the pivot. Specifically, an actuator 23 (FIG. 7) such as an electric motor or a rotary cylinder is connected to the shaft 21 and the actuator 23 enables the feed-in deflector 22 to rotate from its up position shown with a solid line to its down position shown with a two-dot chain line in FIG. 2. Further, when the feed-in deflector 22 turns from its up position toward its down position, the feed-in deflector 22 cuts the tobacco rod TR at the terminal part of the wrapping section 6. More specifically, although the details are not illustrated, a cutter 25 is provided in a part of the feed-in deflector 22 and the cutter 25 cuts the tobacco rod TR in cooperation with a fixed blade (not illustrated) located on the side of the wrapping section 6. Even when the feed-in deflector 22 is in its up position, the feed-in deflector 22 does not interfere with the delivery of the tobacco rod TR from the wrapping section 6.

Further, between the wrapping section 6 and the measuring device 16, a rod guide 24 1s arranged on the wrapping section side and a dust box 28 (FIG. 1) is provided below the rod guide 24.

The rod guide 24 is positioned at the same level as the delivery axis of the tobacco rod TR extending from the wrapping section 6 toward the measuring device 16.

In addition, as shown in FIG. 2, the housing 20 of the measuring device 16 has an inlet 20*a* for introducing the tobacco rod TR and an outlet 20*b* for leading out the tobacco rod TR.

Figure 3:
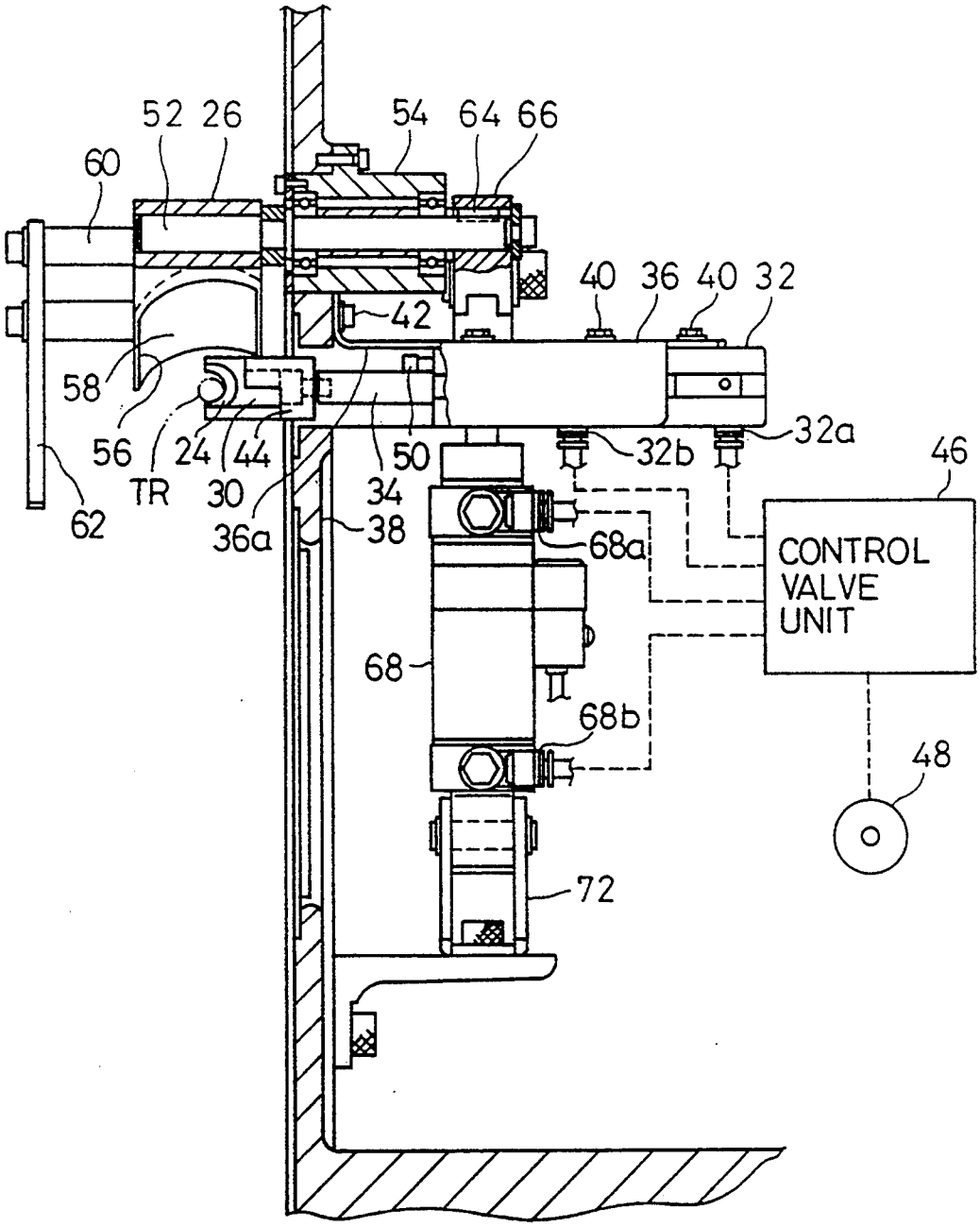
FIG. 3 is a cross-sectional view along the line III—III in FIG. 2.

As shown in FIG. 3, the rod guide 24 includes a member shaped like a halved pipe and it has a semicircular cross-section of which the radius is slightly larger than the that of the tobacco rod. The rod guide 24 is mounted on a support 30 with its open side facing toward the delivery axis of tobacco rod TR.

The support 30 is connected to a pair of piston rods 34 of an air cylinder 32, these piston rods 34 extending horizontally. The air cylinder 32 is mounted on a main frame 38 of the cigarette manufacturing apparatus via a cylinder bracket 36. The cylinder bracket 36 is shaped so that it embraces the air cylinder 32 from above and it is connected to the air cylinder 32 via a plurality of mounting screws 40. From the cylinder bracket 36, a bracket arm 36*a* extends toward the main frame 38 and is connected to the main frame 38 via a plurality of mounting screws 42.

Figure 4:
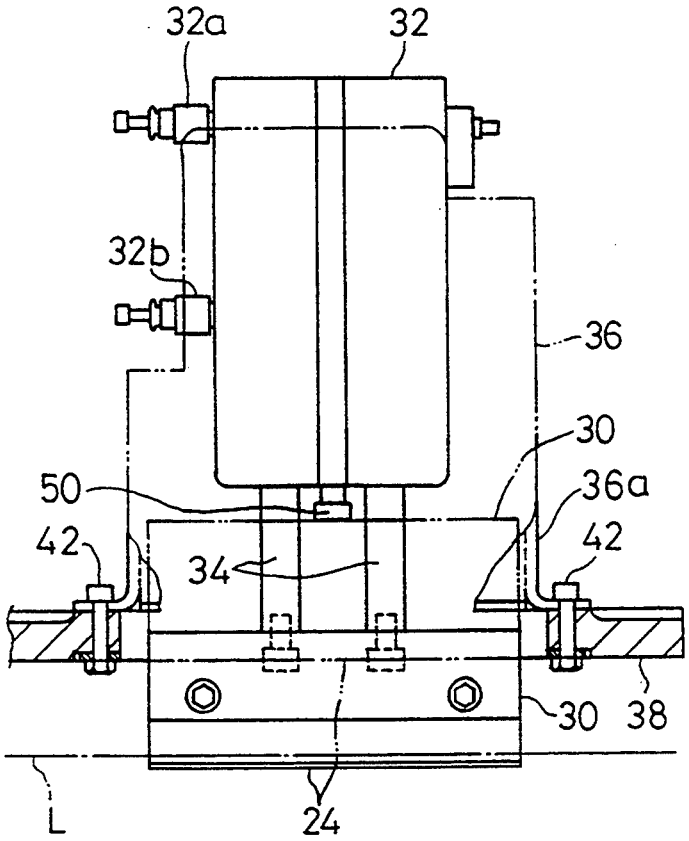
FIG. 4 is a top view showing a rod guide and its surroundings.

Further, the main frame 38 has an opening 44 formed at the same level as the support 30 and this opening 44 also extends in the delivery direction of tobacco rod TR as shown in FIG. 4. In FIG. 4, the delivery axis L for tobacco rod TR is shown with a one-dot chain line.

The air cylinder 32 is of a double-acting type, therefore the air cylinder 32 has a pair of ports 32*a* and 32*b*. These ports 32*a* and 32*b* are connected to a control valve unit 46 via pneumatic hoses and the control valve unit 46 is connected to a pneumatic source 48.

Accordingly, the control valve unit 46 controls the supply of air pressure from the pneumatic source 48 and discharge of air pressure from the air cylinder 32, with respect to the pair of ports 32*a* and 32*b* of the air cylinder 32. This causes the pair of piston rods 34 of the air cylinder 32 to expand or contract.

When the pair of piston rods 34 expand, the support 30, i.e., the rod guide 24, is located in the forward position shown with a solid line in FIG. 4, while the rod guide 24 is located in the backward position shown with a two-dot chain line when the pair of piston rods 34 contract. Hence, the rod guide 24 moves between the forward position and the backward position through the opening 44 of the main frame 38.

When the rod guide 24 is in the forward position as shown in FIG. 3, the tobacco rod TR delivered from the wrapping section 6 is supplied to the measuring device 16 while it is supported and guided by the rod guide 24. On the other hand, when the rod guide 24 is in the backward position, the rod guide 24 is away from the delivery axis L of the tobacco rods TR, fully sinking in the opening 44 of the main frame 38. The backward position of the rod guide 24, i.e., the support 30, is determined by a stopper 50 provided on the air cylinder 32.

As shown in FIG. 2, a rod deflector 26 is provided above the rod guide 24. One end of the rod defector 26 located on the wrapping section side is mounted on the main frame 38 via a shaft 52. This shaft 52, as shown in FIG. 3, passes through a bearing unit 54 fixed on the main frame 38 and it is supported by the bearing unit 54 so that it is allowed to rotate.

The rod deflector 26 is shaped like a rectangular block which extends from the shaft 52 toward the measuring device 16. The bottom surface of the rod deflector 26 has a guiding groove 56 which extends from one end to the other end of the rod deflector 26 and whose concavity faces downward. The downward-facing bottom surface or the guide groove 56 is specified as a deflecting surface 58 which is shaped as a circular arc in the delivery direction of tobacco rod TR. Further, as shown in FIG. 3, the deflecting surface 58 is a circular arc even when it is viewed in a direction which crosses the delivery direction of tobacco rod TR at a right angle.

Figure 5:
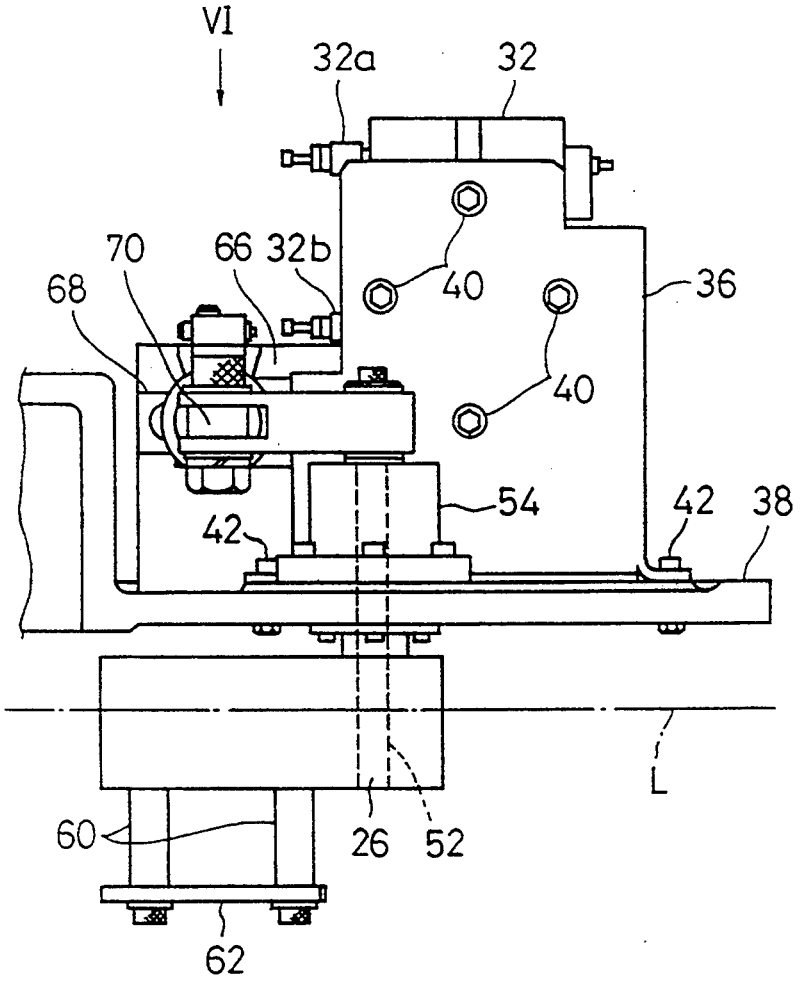
FIG. 5 is a top view showing a rod deflector and its surroundings.
Figure 6:
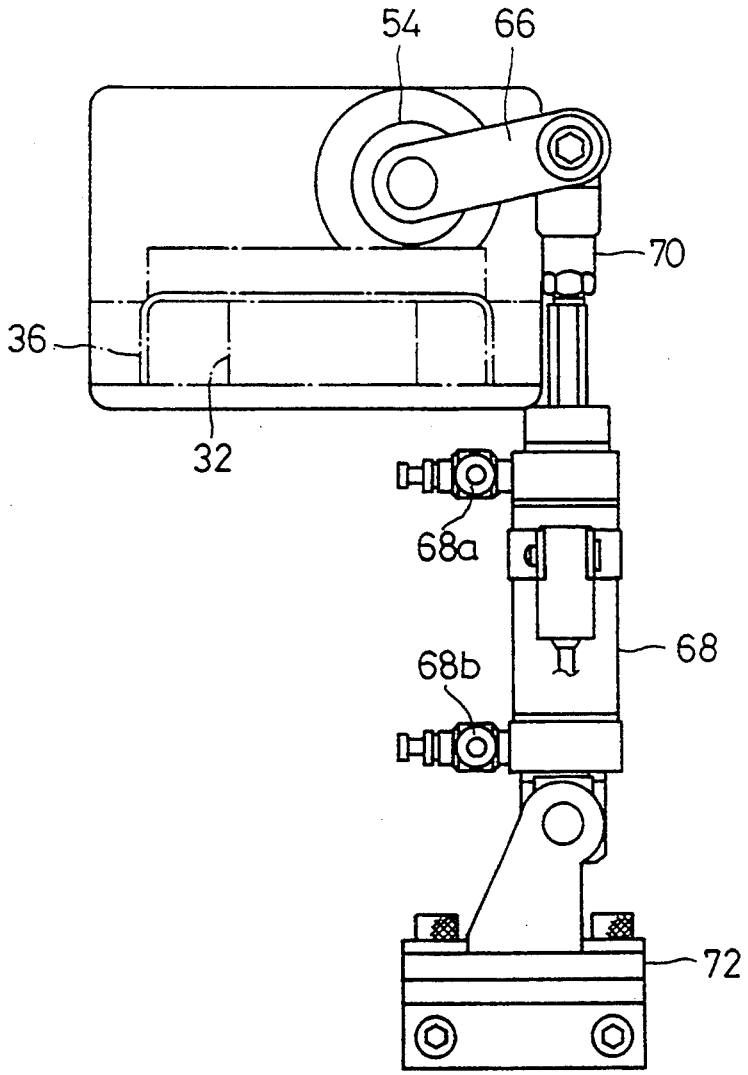
FIG. 6 is a view observed from the direction VI in FIG, 5.

The shaft 52 of the rod deflector 26 projects from the bearing unit 54 and one end of an arm 66 is connected to the projecting end of the shaft 52 via a key 64 as shown in FIG. 3. The other end of the arm 66 is connected to a piston rod 70 which extends from an air cylinder 68 as it becomes more obvious by referring to FIG. 5 and FIG. 6. The air cylinder 68 is installed perpendicularly and the bottom end of the air cylinder 68 is supported by a cylinder bracket 72, which is fixed to the main frame 38, so that it is allowed to rotate.

The air cylinder 68 is also of a double-acting type like the air cylinder 32 previously mentioned. As it is obvious from FIG. 3, a pair of ports 68*a* and 68*b* of the air cylinder 68 are also connected to the control valve unit 46 via pneumatic hoses. Hence, the operation, i.e., the expansion and contraction, of the air cylinder 68 is also controlled by the control valve unit 46 and the rod deflector 26 rotates around the shaft 52 as the air cylinder 68 expands or contracts.

To describe detailedly about the control valve unit 46, the control valve unit 46 incorporates a pair of direction switching valves of electromagnetic actuated type, to operate the air cylinders 32 and 68 independently.

When the rod deflector 26 is in the up position, shown in FIG. 3, the whole rod deflector 26 is positioned higher than the delivery axis L of tobacco rod TR. When, however, the rod deflector 26 is rotated around the shaft 52 downward by the air cylinder 68 as shown in FIG. 2, moving it down from the up position to the down position, the deflecting surface 58 of the rod deflector 26 shuts off the delivery axis L of tobacco rod TR.

Furthermore, when the rod deflector 26 rotates from its up position to its down position, the rod deflector 26 cuts the tobacco rod TR. More specifically, the rod deflector 26 has a cutter 27 provided on its tip and the cutter 27 cuts the tobacco rod TR in cooperation with the inlet 20*a* of the housing 20. Hence, in this case, the end surface of the inlet 20*a* functions as a fixed blade for the cutter 27.

As it is obvious from FIG. 3, a cover 62 is mounted on the front surface of the rod deflector 26 via a pair of spacers 60.

Figure 7:
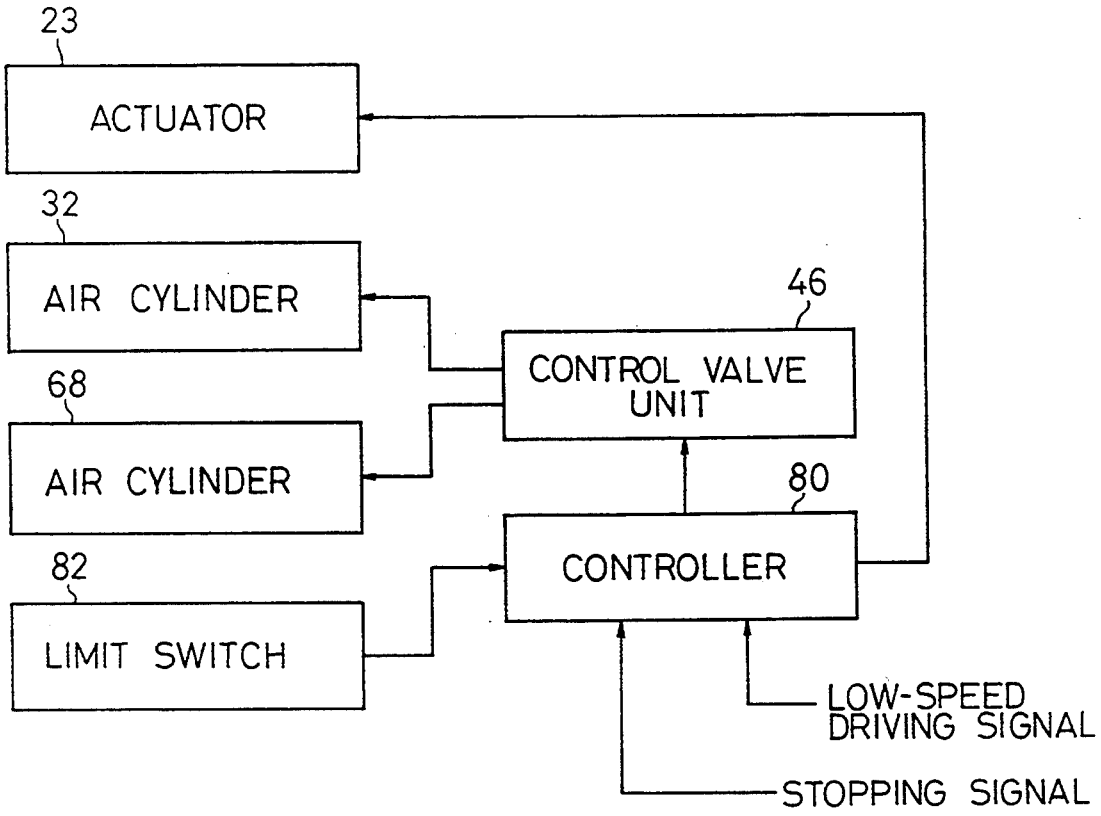
FIG. 7 is a control block diagram of the rod guide and the rod deflector.

The operation of the feed-in deflector 22, rod guide 24, and rod deflector 26 is controlled by a controller 80 shown in FIG. 7. Specifically, the controller 80 is electrically connected to the control valve unit 46 and the actuator 23 off the feed-in deflector 22.

Figure 8:
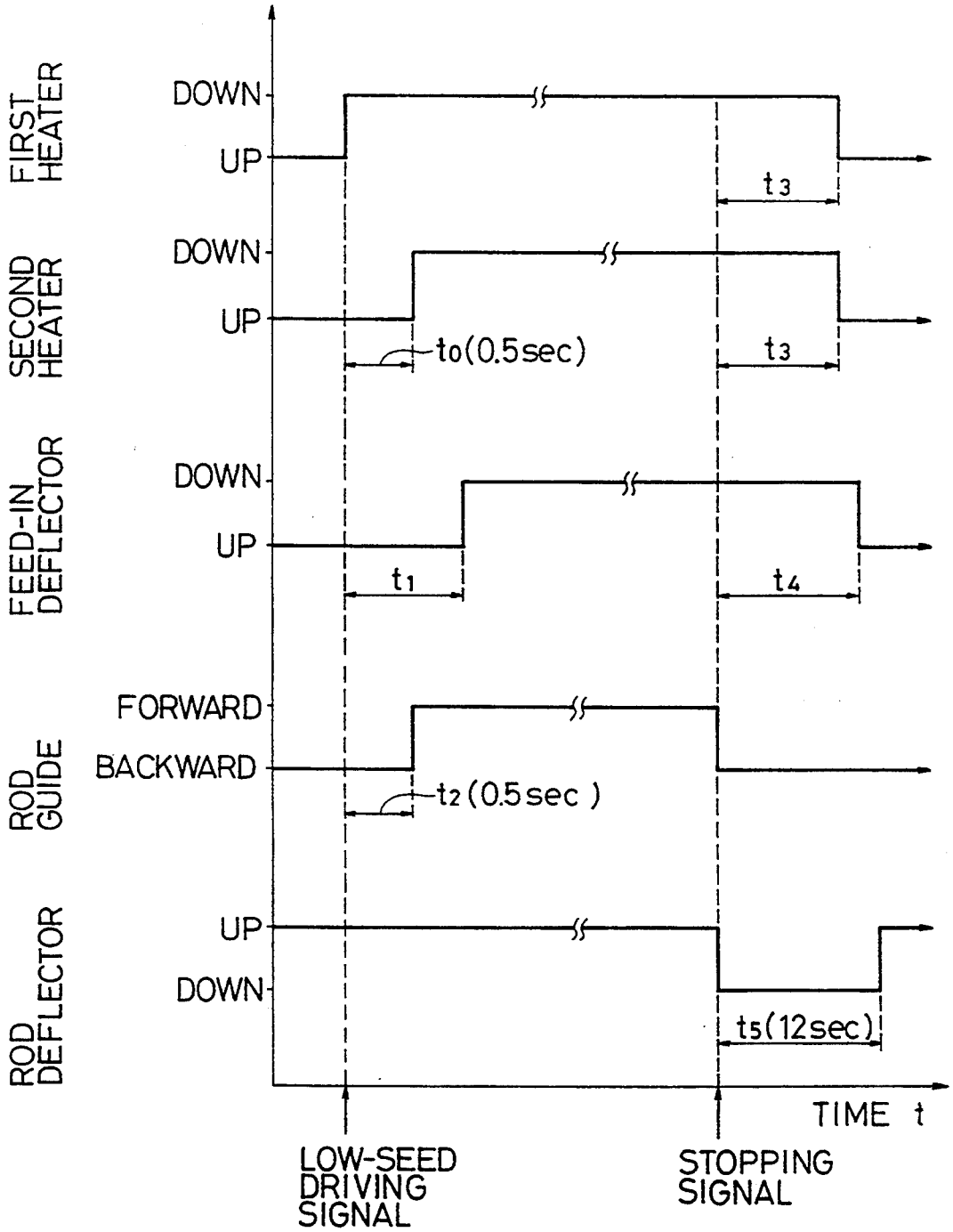
FIG. 8 is a timing chart showing the operation timings of the rod guide and the rod deflector.

FIG. 8 shows the operation timings of the first and second heaters 12 and 14, feed-in deflector 22, rod guide 24, and the rod deflector 26 during a period in which the cigarette manufacturing apparatus is started at low speed from its stopped state then the operation is stopped.

When the cigarette manufacturing apparatus is in a stopped state, the heaters 12 and 14, and the feed-in deflector 22 are in their up positions, the rod guide 24 is in its backward position, and the rod deflector 26 is in the up position. Therefore, the delivery axis L of the tobacco rods TR between the wrapping section 6 and the measuring device 16 is not shut off by the rod deflector 26, the delivery axis L being left open. At this time, the tobacco rod TR, which has been formed, is being sent out from the end of the wrapping section 6, with the tip of the tobacco rod TR being led into the dust box 28 shown in FIG. 1.

From the stopped state described above, when a low-speed driving signal is supplied to the cigarette manufacturing apparatus, the paper web 8 runs as the garniture tape 10 runs at the wrapping section 6. Further, the formation of tobacco rod TR is started as shredded tobacco is supplied onto the paper web 8.

As shown in FIG. 8, the time of the low-speed driving signal is issued, the first heater 12 is moved from its up position to its down position, while the second heater 14 is moved from its up position to its down position after a predetermined time to (e.g., 0.5 sec.) elapses following the output of the low-speed driving signal. When the first and second heaters are moved to the down positions in such a manner, the glued portion of the formed tobacco rod TR is subjected to the drying process.

When the first heater 12 reaches its down position, the descent of the first heater 12 is detected by a limit switch 82 and the detection signal is output from the limit switch 82 to the controller 80.

Following the output of the detection signal, the controller 80 drives the actuator 23 in synchronization of the operation of the cutting section 18 after a predetermined time $t_1$ (e.g., 1 sec.) elapses, thus causing the feed-in deflector 22 to rotate from its up position to its down position. At this time, as previously described, the feed-in deflector 22 cuts the tobacco rod TR sent out from the wrapping section 6 to the measuring device 16. Thus, by this cutting operation, the part of the tobacco rod TR being led from the wrapping section 6 to the dust box 28 is separated from the tobacco rod TR on the side of the wrapping section 6 and the part drops into the dust box 28.

On the other hand, the low-speed driving signal is also supplied to the controller 80 and the controller 80 switches the control valve unit 46 after a predetermined time $t_2$ (*e.g.*, 0.5 sec.) elapses following the output of the low-speed driving signal, thereby causing the piston rod 34 of the air cylinder 32 to expand. Thus, the rod guide 24 is moved from its backward position to its forward position. In the forward position, the rod guide 24 is located so that its axis is aligned with the delivery axis L of the tobacco rod TR as shown in FIG. 3.

As it is obvious from the above description, the rod guide 24 will have already been located in the forward position when the tobacco rod TR, which has been cut by the feed-in deflector 22, is sent out from the wrapping section 6 after the low-speed driving signal is issued. Therefore, when the tobacco rod TR is delivered out from the wrapping section 6, the cut end of the tobacco rod TR is sent out toward the measuring device 16 while it is guided by the rod guide 24 and it is smoothly introduced into the measuring device 16 through its inlet 20*a*. After that, the tobacco rod TR is led out of the measuring device 16 through the outlet 20*b* thereof, then it is supplied to the cutting section 18.

During the low-speed operation of the cigarette manufacturing apparatus, the tobacco rod TR delivered from the wrapping section 6 is supported and guided by the rod guide 24 toward the measuring device 16, therefore, the sway of time tobacco rod TR is controlled by the rod guide 24. As a result, it is possible to prevent the tobacco rod TR from being scratched by the edge of the inlet 20*a* of the measuring device 16, thus securely protecting the tobacco rod TR from rupture. The rupture of tobacco rod TR is a major cause of shutdown of the cigarette manufacturing apparatus.

While the cigarette manufacturing apparatus is driving, the tobacco rod TR, which has been incompletely formed due to defective gluing of the paper web 8, is detected, a stopping signal is supplied to the cigarette manufacturing apparatus. The issued stopping signal brakes the drive of the wrapping section 6.

The stopping signal is also supplied to the controller 80 and the controller 80 switches the control valve unit 46 as soon as it receives the stopping signal, thereby causing the air cylinders 32 and 68 to contract. Hence, the rod guide 24 is moved from the forward position to the backward position, and at the same time, the rod deflector 26 is moved from the up position to the down position.

When the rod deflector 26 descends, the rod deflector 26 cuts the tobacco rod TR in cooperation with the inlet 20*a* of the measuring device 16, then it is positioned in the down position. In the down position, the rod deflector 26 shuts off the delivery axis L of the tobacco rod TR.

After the tobacco rod TR 1s cut by the rod deflector 26, the subsequent tobacco rod TR sending from the wrapping section 6 is guided by the deflecting surface 58 of the rod deflector 26 and its delivery is directed toward the dust box 28, thereby causing the tobacco rod TR to drop into the dust box 28 from its cut end.

When the delivery direction of the tobacco rod TR is deflected in such a manner, the subsequent tobacco rods TR is directly led to the dust box 28 from the wrapping section 6 as shown with the two-dot chain line in FIG. 2. This condition continues until the drive of the wrapping section 6 is completely stopped. Hence, the tobacco rods TR paid out from the wrapping section 6 are collected into the dust box 28 until the drive of the wrapping section 6 is completely stopped. This prevents the tobacco rods TR from being scattered between the measuring device 16 and the wrapping section 6 and it also prevents the shredded tobacco in the tobacco rods TR from scattering around.

In the case of the shutdown due to the defectively formed tobacco rod TR described above, the tobacco rod TR remains in the measuring device 16 and the cutting section 18, however, the remaining rod can be easily removed after the cigarette manufacturing apparatus shuts down. To be more specific about this point, when the tobacco rod TR is cut by the rod deflector 26, the subsequent tobacco rod TR sent out from the wrapping section 6 is led to the dust box 28 in the manner described above, therefore, the cut end of the tobacco rod TR does not run into the inlet 20*a* of the measuring device 16, thus securely preventing the tobacco rod TR from being jammed in the measuring device 16. Accordingly, after the shutdown of the cigarette manufacturing apparatus, the remaining rod can be removed from these cutting section 18 and the measuring device 16 simply by pulling It out of the cutting section 18.

As shown in FIG. 8, the heaters 12 and 14 are held in their down positions until a prescribed time $t_3$ elapses after the stopping signal is issued. This prevents the tobacco rod TR from deviating from the forming path on the wrapping section 6.

Further, when a predetermined time $t_4$ ($>t_3$) elapses from the output of the stopping signal, the feed-in deflector 22 is moved from its down position back to its up position. The rod deflector 26 is moved from its down position back to its up position after a prescribed time $t_5$ (e.g., 12 sec.), which is longer than $t_4$, elapses.

The present invention is not limited to the apparatus according to the embodiment described above but it can be implemented in various modifications.

For instance, the rod guide 24 moves linearly between its forward position and backward position, but it may perform rotary motion between its forward position and backward position just like the rod deflector 26. Likewise, the rod deflector 26 rotates from the up position to the down position to shut off the delivery axis L of the tobacco rods TR, but it may rotate from the down position to the up position to shut off the delivery axis L.

Also, in the above-mentioned embodiment, the rod deflector 26 is located on the downstream side of the rod guide 24, but the rod deflector 26 may be located near the feed-in deflector 22, and these deflectors 22 and 26 may be composed as a single unit.

In the cigarette manufacturing apparatus, the inspecting section may incorporate a detecting device for detecting the filling density of shredded tobacco in tobacco rod TR, instead of the measuring device 16 designed to measure the diameter or tobacco rod TR.

What is claimed is:

1. A tobacco rod guiding device having an entrance and an exit for guiding tobacco rod traveling in a cigarette manufacturing apparatus, comprising:

a feed-in-deflector pivotable about a horizontal axis and provided with a first cutting means for cutting the tobacco rod;

a delivery axis for tobacco rod which extends from the entrance to the exit; and a rod guide movable perpendicularly in a horizontal plane relative to said delivery axis to an operating position on said delivery axis, said rod guide directing the travel of tobacco rod sent out from the entrance and leading the tobacco rod to said exit, said rod guide being in constant contact with the tobacco rod while a tobacco rod cut end is delivered to said exit.

2. The device according to claim 1, wherein said device further comprises second cutting means for cutting the tobacco rod at a cutting position between the entrance and the exit when the cigarette manufacturing apparatus shuts down, and deflecting means which guides and orients, after the tobacco rod is cut by said second cutting means, the cut end of the tobacco rod on an entrance side downward from said delivery axis and deflects the delivery direction of the tobacco rod from the entrance.

3. The device according to claim 2, wherein said second cutting means has a cutting position between the exit and said rod guide, and said rod guide includes a halved pipe member, the opening of the pipe member facing one horizontal side of said delivery axis, said device further comprising driving means which horizontally moves said rod guide in the operating position from said delivery axis to a standby position away from said delivery axis at the same time as the tobacco rod is cut by said second cutting means.

4. The device according to claim 3, wherein said second cutting means includes a cutting member, which is located in a non-operating position away from said delivery axis, and second driving means, which moves the cutting member between said non-operating position and a shut-off position where said delivery axis is shut off, the cutting member cutting the tobacco rod when said cutting member rotatably moves from said non-operating position to the shut-off position.

5. The device according to claim 4, wherein said deflecting means has a deflecting surface on the cutting member on the side which faces toward the entrance when the cutting member is in the shut-off position, the deflecting surface guiding the cut end of the tobacco rod to a downward direction.

6. The device according to claim 5, wherein said device further comprises a controlling means which controls said first and second driving means.

7. The device according to claim 6, wherein said controlling means causes said rod guide to move horizontally from the standby position to the operating position by the first driving means before the tobacco rod is cut by said first cutting means when the cigarette manufacturing apparatus is restarted.

8. The device according to claim 7, wherein each of said first and second driving means includes an air cylinder, a common pneumatic source for supplying air pressure to the air cylinders, and a valve unit which switches the direction of air pressure supplied to each of the air cylinders and which is located between the pneumatic source and the air cylinders, and said controlling means includes a controller which controls the switching of the valve unit.

9. The device according to claim 1, wherein said first cutting means cuts the tobacco rod at the entrance to form a cut end of the tobacco rod when the cigarette manufacturing apparatus is restarted.

10. The device according to claim 1, wherein said rod guide is elongated and extends along said delivery axis.

11. A tobacco rod guiding device having an entrance and an exit for guiding a tobacco rod traveling in a cigarette manufacturing apparatus, comprising:

a feed-in-deflector pivotable about a horizontal axis provided with a first cutter for cutting the tobacco rod;

a delivery axis for the tobacco rod which extends from the entrance to the exit;

a rod guide independently movable with respect to said first cutter during a cutting operation of said first cutter, the rod guide being horizontally movable relative to said delivery axis for directing the travel of the tobacco rod along said delivery axis a second cutter, pivotably mounted above said delivery axis and independently movable with respect to said rod guide and said first cutter during a cutting operation of said second cutter, the second cutter having cutting means for cutting the tobacco rod at a cutting position between the entrance and the exit when the cigarette manufacturing apparatus shuts down; and deflecting means, pivotably mounted with said second cutter above said delivery axis, for guiding a cut end of the tobacco rod after the tobacco rod is cut by said second cutter, the cut end of the tobacco rod being deflected downwardly by the deflecting means away from said delivery axis.

12. The device according to claim 11, wherein said second cutter has a cutting position between the entrance and said rod guide, and said rod guide includes a halved pipe member, the opening of the pipe member facing one side of said delivery axis, said device further comprising driving means which horizontally moves said rod guide in the operating position from said delivery axis to a standby position away from said delivery axis at the same time as the tobacco rod is cut by said second cutter.

13. The device according to claim 12, wherein said second cutter includes a cutting member, which is located in a non-operating position away from said delivery axis, and second driving means, which moves the cutting member between said non-operating position and a shut-off position where said delivery axis is shut off, the cutting member cutting the tobacco rod when it moves from said non-operating position to the shut-off position.

14. The device according to claim 13, wherein said deflecting means has a deflecting surface on the cutting member on a side which faces toward the entrance when the cutting member is in the shut-off position, the deflecting surface guiding cut end of the tobacco rod to a downward direction.

15. The device according to claim 14, wherein said device further comprises a controlling means which controls said first and second driving means.

16. The device according to claim 15, wherein said controlling means causes said rod guide to move from the standby position to the operating position by the first driving means before the tobacco rod is cut by said first cutter when the cigarette manufacturing apparatus is restarted.

17. The device according to claim 16, wherein each of said first and second driving means includes an air cylinder, a common pneumatic source for supplying air pressure to the air cylinders, and a valve unit which switches the direction of air pressure supplied to each of the air cylinders and which is located between the pneumatic source and the air cylinders, and said controlling means includes a controller which controls the switching of the valve unit.

18. The device according to claim 11, wherein said first cutting means cuts the tobacco rod at the entrance to form a cut end of the tobacco rod when the cigarette manufacturing apparatus is restarted.

19. The device according to claim 11, wherein said rod is elongated and extends along said delivery axis.

* * * * *